United States Patent [19]

Daugirda

[11] Patent Number: 4,813,383

[45] Date of Patent: Mar. 21, 1989

[54] WATER HEATER TANK FLUSHING DEVICE

[75] Inventor: Paul G. Daugirda, Evergreen Park, Ill. 60642

[73] Assignee: Rheem Manufacturing Company, Chicago, Ill.

[21] Appl. No.: 71,623

[22] Filed: Jul. 9, 1987

Related U.S. Application Data

[63] Continuation of Ser. No. 916,874, Oct. 9, 1986, abandoned.

[51] Int. Cl.[4] ..... F22B 7/00

[52] U.S. Cl. ..... 122/159; 122/283

[58] Field of Search ..... 122/381, 382, 383, 388, 122/159

[56] References Cited

U.S. PATENT DOCUMENTS

| | | | |
|---|---|---|---|
| 1,648,028 | 11/1927 | Purvis | 122/381 |
| 4,157,077 | 6/1979 | Lindahl | 122/159 |
| 4,263,879 | 4/1981 | Lindahl | 122/159 |
| 4,505,231 | 3/1985 | Syler | 122/383 X |
| 4,566,406 | 1/1986 | Appleman | 122/383 X |

OTHER PUBLICATIONS

State Water Heaters, "Turbo 85+", their form No. TB 85B/885.

State Water Heaters, "Turbo 85+ Super-Saver", their form No. ST G9-785 (1985).

State Water Heaters, "Turbo Sandblaster", their form No. SUB 3/1183.

State Water Heaters, "Sandblaster", their form No. SWS 282.

State Water Heater, "State Begins a New Era in Water Heaters".

State Water Heater, "Turbo Sandblaster", their form No. SWS 385.

*Primary Examiner*—Edward G. Favors

*Attorney, Agent, or Firm*—Allegretti & Witcoff, Ltd.

[57] ABSTRACT

An improved mechanism for a water heater flushing of sediment from the bottom of tank diverts inlet water through an auxiliary tube directed to the bottom of the tank. Thus, when a spigot is opened at the bottom of the tank and water is simultaneously diverted through the flush tube, sediment can efficiently be removed from the tank.

10 Claims, 2 Drawing Sheets

WATER HEATER TANK FLUSHING DEVICE

This is a continuation of application Ser. No. 916,874 filed Oct. 9, 1986 abandoned.

BACKGROUND OF THE INVENTION

In a principal aspect, this invention relates to sediment flushing apparatus in a water heater tank.

In a typical residential water heater having a cylindrical tank, the water to be heated is introduced into the lower portion of the tank through an inlet conduit and withdrawn from the upper portion of the tank through an outlet. Due to naturally occurring properties of the water, sediment and/or hard water scale may collect in the bottom of the tank.

Hard water scale collects in water heater tanks because its solubility decreases as the water temperature increases. Thus, cold inlet water includes, minerals in solution, such as calcium carbonate, etc. that precipitate from the water as it is heated and collect as sediment at the bottom of the water heater tank. As the sediment collects and coats the bottom of the tank, it impeded the heat transfer capabilities of the tank, thereby reducing the thermal efficiency of the water heater. Thus, it is desirable to remove the sediment from the water heater tank to maintain the efficiency of the water heater.

The most familiar method of removing sediment from the bottom of a water heater tank is to periodically drain a portion of the contents of the tank. To this end, water heater tanks are generally provided with drain valves at their lower end. Historically, sediment has been removed from the water heater tank through the drain valve by merely opening the drain valve and permitting the natural movement of water as the tank empties to sweep the sediment out of the tank. A problem associated with this method is that the velocity of the water caused by the natural draining movement is insufficient to sweep all of the sediment out of the bottom of the water heater tank. Therefore, a portion of the sediment fails to be dislodged or removed from the bottom of the tank. Particularly, larger aggregations of sediment remain in the bottom of the water heater tank and are not swept away by the water's natural movement during such draining. Consequently, to achieve acceptable heat transfer characteristics, the tank must be drained relatively frequently.

Another method of removing sediment that collects in the bottom of a water heater tank is to divert the influent water along the bottom of the tank so as to agitate the sediment whenever influent water is entering the tank. This is usually accomplished by decreasing the cross section of the inlet conduit so as to effect a higher average velocity of the influent water. This influent stream can then be directed to agitate the sediment and divert it upward off of the bottom of the tank. As heated water is drawn out of the bottom of the water heater tank, sediment at the bottom is agitated, diverted upward from the bottom of the tank, and swept out of the outlet conduit with the heated water. Devices employing this method are disclosed in U.S. Pat. No. 4,263,879, issued to Lindahl on Apr. 28, 1981, and U.S. Pat. No. 4,157,077, issued to Lindahl on June 5, 1979.

A problem associated with the continuous removal of sediment from the water heater tank is that the sediment is carried out of the tank into plumbing lines downstream from the tank. This sediment can collect in plumbing, such as solenoids in dishwashers, clothes washer, faucet aerators, shower heads, etc. which can necessitate costly repairs. Another problem associated with the continuous removal of sediment from the water heater, is that the sediment can find its way into the water to be consumed. These particles of sediment, although not harmful, can find their way into or onto hair, dishes, clothes, etc.

The present invention constitutes a sediment flushing apparatus for a water heater tank that seeks to overcome the problems resulting from sediment collection in the bottom of a water heater tank while at the same time providing a simple, easily constructed design that does not adversely affect either the heated water, the downstream equipment, and which is inexpensive to operate and maintain.

SUMMARY OF THE INVENTION

Briefly, the pesent invention comprises an improved sediment flushing apparatus for a water heater tank. The sediment flushing apparatus includes a sediment flushing tube located inside the water tank inlet conduit which extends into the sediment collecting portion or bottom of the tank. A diverter valve is provided in the inlet conduit for diverting water from the inlet conduit through the sediment flushing tube. The drain valve, a component of the water heater, is opened during flushing to facilitate removal of the sediment from the tank.

Thus, it is an object of the present invention to provide a sediment flushing apparatus that operates to flush sediment from the water heater tank, thereby enhancing the overall efficiency of the water heater.

A further object of the present invention is to provide a sediment flushing apparatus wherein the sediment is more completely removed from the water heater tank during flushing of the tank, thus reducing the frequency of the flushing cycles necessary to keep the tank clean.

A further object of the present invention is to provide a sediment flushing apparatus wherein the presence of sediment, or hard water scale in the water discharged from the outlet of the tank is avoided.

Yet another object of the present invention is to provide a sediment flushing apparatus that operates to avoid sediment in consumable water and does not add to the presence of sediment and scale in the plumbing downstream from the water heater.

These and other objects, advantages and features of the present invention will be apparent from the detailed description that follows.

BRIEF DESCRIPTION OF THE DRAWING

In the detailed description that follows, reference will be made to the drawing comprised of the following figures.

DESCRIPTION OF THE PREFERRED EMBODIMENTS

Figure 5:
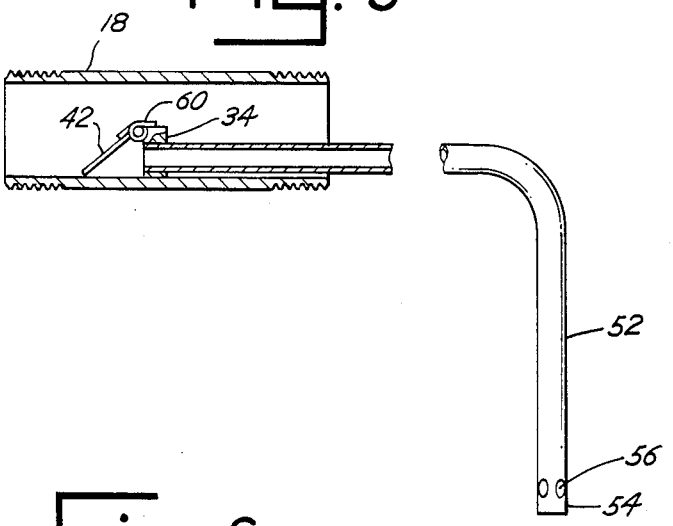
FIG. 5 is a cross-sectional side view of a second embodiment of the apparatus showing the diverter valve in the closed position.
Figure 6:
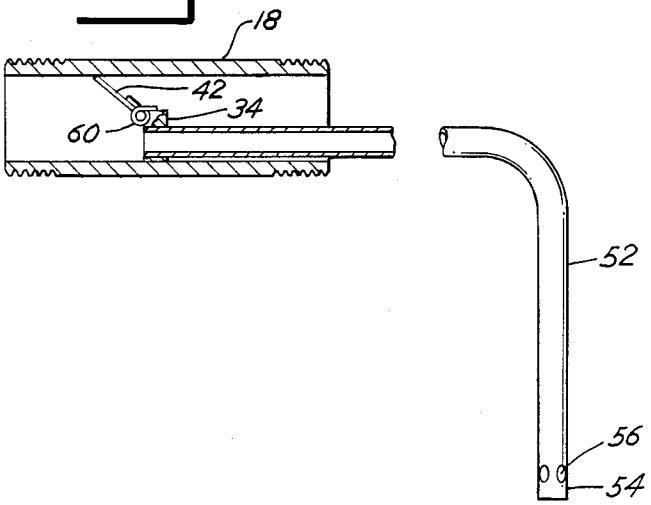
FIG. 6 is a cross-sectional side view of the second embodment of the apparatus showing the diverter valve in the open position.
Figure 7:
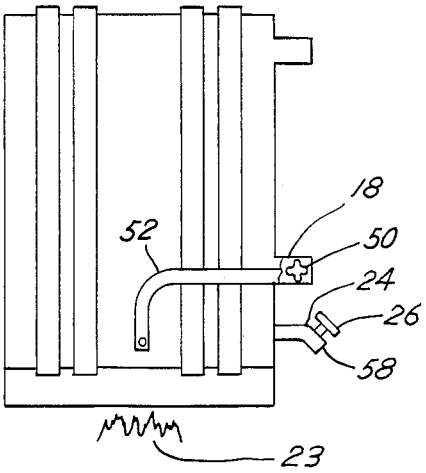
FIG. 7 is a cross-sectional, side elevation of the second embodiment of the apparatus in a water heater tank.

FIGS. 1–4 depict a first specific embodiment of the invention. FIGS. 5–7 illustrate a second embodiment.

Referring therefore to FIGS. 1–4, the sediment flushing apparatus 10 of the invention is incorporated in a residential water heater tank 12. The water heater tank 12 is a general and known configuration and comprises a generally cylindrical tank having a bottom or lower pan 14 and a cylindrical side wall 16. An inlet conduit 18 is provided through the side wall 16 in the general region of the bottom 14. The inlet 18 is provided for the introduction of cold inlet water 20. An outlet conduit 22 is provided in the cylindrical wall 16 for removal of heated water in the top tank 12. This general construction is well known to those of ordinary skill in the art.

The tank 12 also includes a lower spigot 24 with a manual valve 26 for draining the tank 12. Heretofore, operation of the lower spigot 24 was recommended periodically in order to drain sediment and other collected material from the tank 12. This was done in order to enhance the heat transfer through the bottom 14 to the contents of the tank 12.

Figure 1:
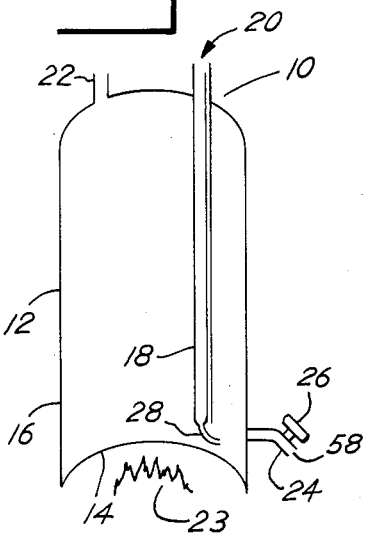
FIG. 1 is a cross-sectional side elevation, schematic side view of a first embodiment of the invention incorporated in a water heater tank.
Figure 2:
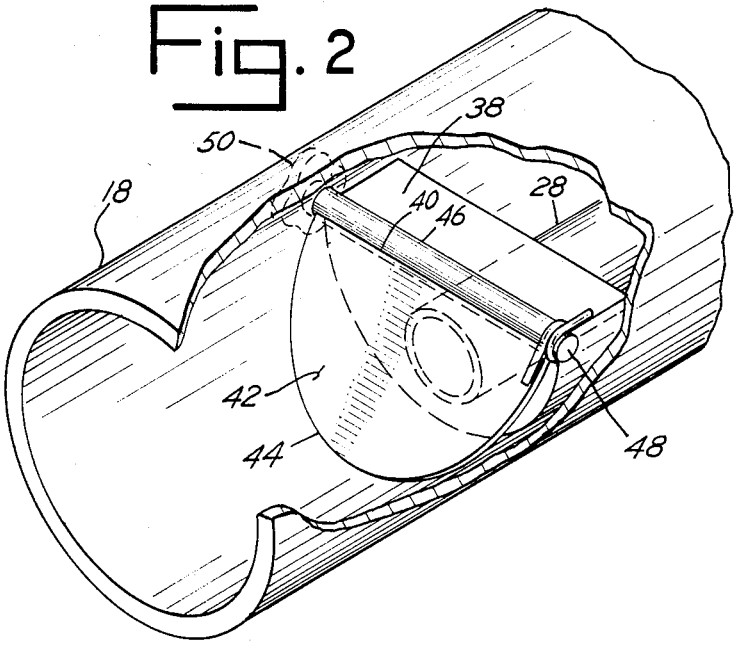
FIG. 2 is a partial cutaway perspective view illustrating a diverter valve construction for the apparatus of the invention.
Figure 3:
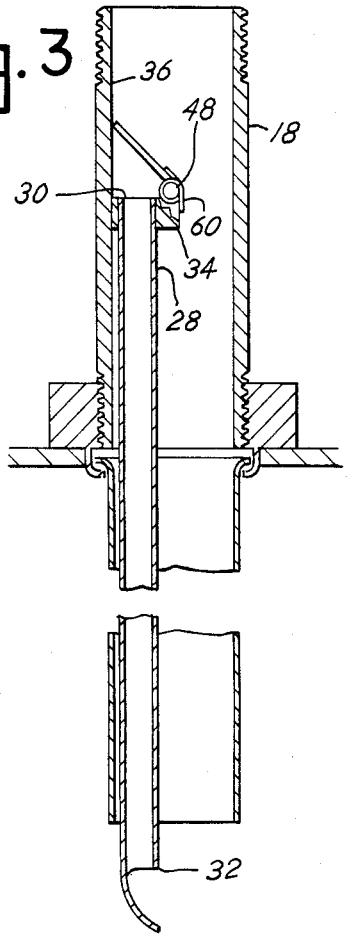
FIG. 3 is a cross-sectional, side elevation of the first vertical embodiment of the apparatus showing the diverter valve in the closed position.
Figure 4:
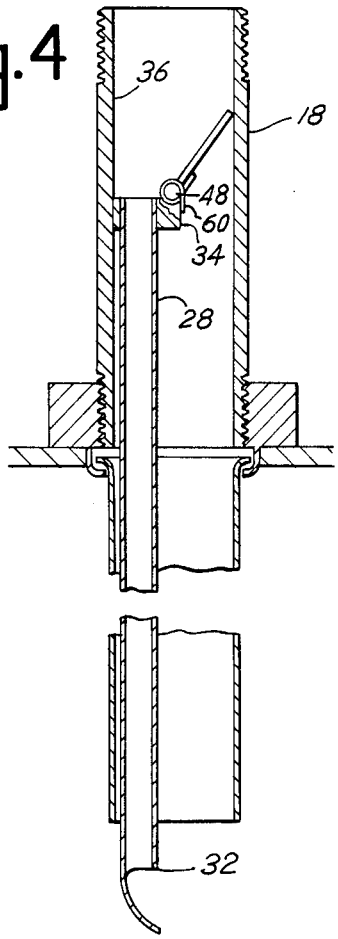
FIG. 4 is a cross-sectional, side elevation of the first embodiment of the apparatus showing the diverter valve in the open position for flushing.

The apparatus 10 of the present invention constitutes a flushing or flush tube 28, located within the inlet conduit 18 as illustrated in greater detail by FIGS. 2, 3, and 4. Specifically in the embodiment of FIGS. 1–4, the flush tube 28 constitutes a uniform diameter tube 28 which extends from a position outside the tank 12 through within the inlet conduit 18, to a position as illustrated in FIGS. 1 adjacent to the bottom 14 of the tank 12 and thus outside the inlet conduit 18. The flush tube 28 defines an inlet terminus 30 and an outlet terminus 32.

The inlet terminus 30 is mounted in a support block 34 which, in the embodiment 10, is semicylindrical in shape and is affixed or is an integral part of a side wall 36 of the inlet conduit 18. This is illustrated in greater detail in FIG. 2. The support block 34 is thus semicylindrical in shape and is attached or is an integral part of the inner side wall 36 of conduit 18. The opposite surfact or flat straight surface 38 of the block 34 defines a chord 40 of the cross-sectional shape of the inlet conduit 18. The tube 28 is affixed to and passes through the block 34. The diverter plate 42 has an arcuate side 44 and a straight line side 46.

A pivot shaft or rod 48 is affixed to the straight line side of the plate 42. The shaft 48 is journaled into the sides 36 of the inlet 18. One end of shaft 48 projects outwardly through one side 36 of the inlet 18. This permits attachment of a manual actuator such as knob 50. In this manner the diverter plate 42 may be pivoted about the shaft 48 between a closed position for the flushing tube 28, illustrated in FIGS. 2 and 3, and an open position as illustrated in FIG. 4.

Note that in the preferred embodiment of the cord that is defined by the shaft 48 constitutes a diameter of the inlet tube 18. In this manner the shape of the plate 42 can be made to conform closely with the shape of the interior side wall 36 of the inlet 18 when the plate 42 is in the position of FIG. 3 (the closed position) and the position illustrated in FIG. 4 (the open position). In both positions the diverter plate 42 effectively blocks the flow of inlet water, diverting it either through the inlet tube 18 or through the flush tube 28. Of course, the shape of the diverter plate 42 may be varied according to need and desire and the described shape is only for purposes of illustration. Thus, the diverter plate 42 may be designed to permit partial passage of water through the inlet 18 even though the plate has been rotated manually to the position depicted in FIG. 4.

In operation then, the embodiment of FIGS. 1–4 is normally positioned as depicted in FIGS. 2 and 3. Thus, the tube 28 is effectively closed to the flow of water therethrough. When, however, sediment is to be flushed from the bottom 14 of the tank 12, the diverter plate 42 is manually actuated and pivoted to the position illustrated in FIG. 4. When the plate 42 is in this position, inlet water 20 is diverted through the tube 28 and out the terminus 32. Simultaneously the spigot 24 is opened, the flow of water into the bottom of the tank 12 through the terminus 32 directs sediment toward the spigot and from the tank 12. Once the tank 12 is flushed in this manner, the diverter plate 42 is pivoted back to the position illustrated by FIG. 3 and of course, the spigot 24 is closed.

FIGS. 5, 6 and 7 illustrate an alternative construction wherein the inlet conduit 18 is positioned in the side wall 16 of tank 12. The inlet 18 in this embodiment is quite short and extends only to the interior of the tank 12. A tube 52 is attached to one side of the inlet conduit 18 and has a diverter plate 42 and support block 34 constructed substantially the same as the embodiment depicted in FIGS. 2, 3, and 4. The tube 52 extends outwardly and downwardly from the conduit 18 and terminates within an apertured end 54 having lateral discharge openings 56. Again, the actuation of the plate 42 is effected by a knob 50 or other manual actuating lever external from the tank 12. Diversion of water through the tube 52 and simultaneous opening of the spigot 24 will effectively flush sediment from the bottom 14 of the tank 12. This results since water is discharged through the nozzel outlet 58 to direct the sediment from the bottom 14 of the tank 12 toward the spigot 24.

As can be seen in FIGS. 3–6, a spring 60 is attached to the diverter plate 42 and the pivot shaft or rod 48 to provide biasing means for biasing the diverter plate in the closed position, as depicted by FIGS. 3–5.

While it has been set forth two preferred embodiments of the invention, it is to be understood that the intention is only limited by the following claims and their equivalents.

What is claimed is:

1. In a water heater tank of the type including an enclosed tank with a bottom portion, a cold water inlet conduit and means for heating the water adjacent the bottom, the improvement comprising, in combination:

a sediment flushing tube, said tube extending from within the inlet conduit to the bottom portion of the tank so as to direct a stream of flushing water against sediment in the bottom of the tank and thereby divert the sediment to a tank discharge position, said flushing tube extending generally parallel with the inlet conduit and having an inlet terminus within the inlet conduit and an outlet terminus spaced from the inlet conduit;

a pivotally mounted diverter plate for covering the tube inlet terminus;

means for pivoting the diverter plate between a closed position covering the tube inlet terminus and an open position for flow of water through the tube; and means for actuating the diverter plate, said means positioned external the tank.

2. The improvement of claim 1 wherein the flushing tube is at least partially within the inlet conduit and has a lesser cross-sectional area than the inlet conduit.

3. The improvement of claim 1 wherein the diverter plate has an arcuate side connected to a straight line side, said straight line side defining a chord of the cross-sectional shape of the conduit.

4. The improvement of claim 3 wherein the chord is a diameter of the conduit.

5. The improvement of claim 1 wherein the means for pivoting comprise a shaft projecting from the diverter plate to the outside of the conduit, and the means for actuating the diverter plate comprise a manual knob attached to the shaft.

6. The improvement of claim 1 wherein the diverter plate is substantially semicircular relative to the cross-sectional area of the inlet conduit.

7. The improvement of claim 1 including drain means in the tank bottom for draining water and sediment from the tank whenever the tube is open.

8. The improvement of claim 1 including biaing means for biasing the diverter plate in the closed position.

9. The improvement of claim 8 wherein the biasing means for biasing the diverter plate in the closed position is provided by a spring operatively associated with the diverter plate and the means for pivoting the diverter plate.

10. In a water heater tank of the type including an enclosed tank with a bottom portion, a cold water inlet conduit, and means for heating the water adjacent the bottom, the improvement comprising, in combination:

a sediment flushing tube, said tube extending from within the inlet conduit to the bottom portion of the tank so as to direct a stream of flushing water against sediment in the bottom of the tank and thereby divert the sediment to a tank discharge position, and flushing tube extending generally parallel with the inlet conduit and having an inlet terminus within the inlet conduit and an outlet terminus spaced from the inlet conduit;

a pivotally mounted diverted plate for covering the tube inlet terminus;

means for pivoting the diverter plate between a closed position, covering the tube inlet terminus, and an open position, for flow of water through the tube;

means for actuating the diverter plate, said means positioned external the tank; and drain means in the tank bottom for draining water and sediment from the tank wherever the tube is open.

* * * * *